United States Patent [19]

Dooley et al.

[11] Patent Number: 5,038,502

[45] Date of Patent: Aug. 13, 1991

[54] RETRACTABLE WORK STATION ATTACHMENT FOR IRONING BOARD AND RETRACTABLE IRONING BOARD SYSTEM

[76] Inventors: Robert E. Dooley; Kimberly A. Felice, both of P.O. Box 147, Sagamore Beach, Mass. 02562

[21] Appl. No.: 416,366

[22] Filed: Oct. 3, 1989

[51] Int. Cl.[5] ..... D06F 81/02

[52] U.S. Cl. ..... 38/106; 38/103; 38/104; 38/107; 38/108; 38/111; 108/118; 108/120; 211/86; 211/116; 248/117.1

[58] Field of Search ..... 38/103, 104, 106, 107, 38/108, 111, 140, 142; 223/106-109 R; 112/217.1; 248/102, 103, 117.1, 205, 226.4, 231.8, 311.1, 309.1; 108/6, 29, 118, 120, 149; 211/86, 88, 90, 116, 134, 149, 150

[56] References Cited

U.S. PATENT DOCUMENTS

| | | | |
|---|---|---|---|
| 511,151 | 12/1893 | Lewis | 38/111 |
| 1,221,487 | 4/1917 | Trifshauser | 38/111 |
| 1,491,035 | 4/1924 | Faris | 38/106 |
| 1,722,859 | 7/1929 | Ravert | 108/121 X |
| 2,514,813 | 7/1950 | Tiegs | 38/111 |
| 2,564,627 | 8/1951 | Rauscher | 38/111 |
| 2,636,294 | 4/1953 | Jacques | 38/111 |
| 3,055,129 | 9/1962 | Selleck | 108/135 |
| 4,154,010 | 5/1979 | Evans | 38/106 |
| 4,184,618 | 1/1980 | Jones | 211/116 X |
| 4,574,503 | 4/1986 | Bertani | 248/117.1 X |

FOREIGN PATENT DOCUMENTS

| | | | |
|---|---|---|---|
| 2359926 | 2/1978 | France | 38/106 |

*Primary Examiner*—Werner H. Schroeder
*Assistant Examiner*—Ismael Izaguirre
*Attorney, Agent, or Firm*—Thomas A. Kahrl

[57] ABSTRACT

A workstation tray device for easy connection with a plurality of collapsible ironing board configurations, for temporary but secure storage of containers of compositions applied to objects being ironed, in hinged cooperation for retractable storage in connection with the ironing board without being detached therefrom. The device consisting of a tray member of resilient material for attachment to a ironing board by of fingers for receiving a hinged adjustable collar for clamping to one ironing board leg, and by two support arms each movably attached, at one end by bolt to the flat end of the board member, and at the other end to a bracket attached to the tray such that the shelf is horizontally disposed under the board in convenient close proximity having adequate clearance for storage of items, all without interfering with the legs and feet of the operator. The arms have arch members hingeably attached to strut to cooperate with the tray.

6 Claims, 2 Drawing Sheets

RETRACTABLE WORK STATION ATTACHMENT FOR IRONING BOARD AND RETRACTABLE IRONING BOARD SYSTEM

BACKGROUND OF THE INVENTION

The present invention relates to providing a workstation to be attached to a conventional ironing board for storing containers of products normally used during the process of ironing, readily accessible to the operator-/user yet which does not interfere with the ironing process and retracts together with the ironing board for easy and compact storage; and to providing a retractable ironing board system.

Ironing board or alternatively ironing board attachments of which applicant is aware are shown in U.S. Pat. Nos. 1,060,194, 1063,685, 1,266,468, 2,514,813, 3,055,129, and 4,154,010.

As dwellings have become more compact responsive to the high cost of housing, space has become limited and activities such as ironing have become more cramped. To perform a proper ironing operation on cloth articles, it is necessary to have the ironing board top surface completely free. However, due to the space shortage prevalent in many apartments and other dwellings, users frequently use the top of the ironing boards to temporarily store containers of spray material, starch and the like, while ironing, resulting in poorer quality ironing and dropped containers.

It therefore is an object of this invention to provide a work station which is spaced apart from the ironing board surface to provide a storage area clear of the working area.

Another object of the present invention is to provide a work station which is conveniently located to be accessed by the user with changing position and provide a stable mounting surface.

A further object of the invention is to provide a workstation attachment which is easily attached to conventional ironing boards without requiring special tools or drilling.

Another object of the invention is to provide a light weight, resilient work station for attachment to retractable ironing boards which is adapted to be retracted together with the ironing board without any disassembly.

SUMMARY OF THE INVENTION

The present invention is directed to an improved work station attachment, and retractable ironing board system employing the improved work station attachment.

The present invention comprises an improved ironing board work station for retraction in cooperation with a conventional ironing board of conventional folding construction having a pointed end and a flat end having a plurality of retractable folding legs to be opened for ironing, and folded for storage.

The work station has a tray with a coupling end and an open end of generally rectangular shape adapted to be attached by clamping means, preferably a pivotally mounted coupling having an expandable collar coated with plastic or rubber, to the rearwardly extending leg, and hingably fastened by retractable arm means at the open end to the flat end of the ironing board. The tray has a plurality, preferably two, of retractable arms each having an arch end and a base end having a arch member section and strut members section, having a tray end and a joint end movably attached by hinge pins to the tray at the distal lower end of the strut member, and securely attached to the flat end of the ironing board by bolt means. The upper arch member is formed in arch having an aperture to receive a conventional bolt to be affixed to one of a plurality of opening normally provided in the flat end of conventional ironing boards; and includes a 90 degree twist at mid section to orient arch base member in the attachment to and alignment with the upper joint end of the strut member.

The tray section is provided with raised rib sections to contain articles and contents of ironing preparations, temporarily stored on the tray such that they do not fall out during the course of ironing. The rib sections provide rigidity to the tray as well as to provide firm mounting shoulder, perpendicularly oriented to the shelf portion; for mounting a plurality of fingers extending outwardly to engage an expandable collar.

Mounting the tray to the ironing board is accomplished by bolting the arch to the flat end of the ironing board by a bolt securely attached to one of a plurality of holes normally provided in conventional ironing boards.

The mounting means for attaching the tray to the rearwardly extending leg of the ironing board comprises an expandable collar with a discontinuity and including outwardly extending tabs providing clamp means and including coupling apertures on opposite sides for coupling engagement of the collar with rivets to the fingers.

As the ironing board is closed by folding the legs inwardly toward the board, and manually disconnecting the coupling from the rearwardly extending leg by opening the collar, the tray being hingably mounted by the support arms, also folds inwardly without interfering with the legs, there being adequate clearance provided between the workstation the rearwardly extending leg which lies in the channel provided between the fingers and the parallel support arms.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
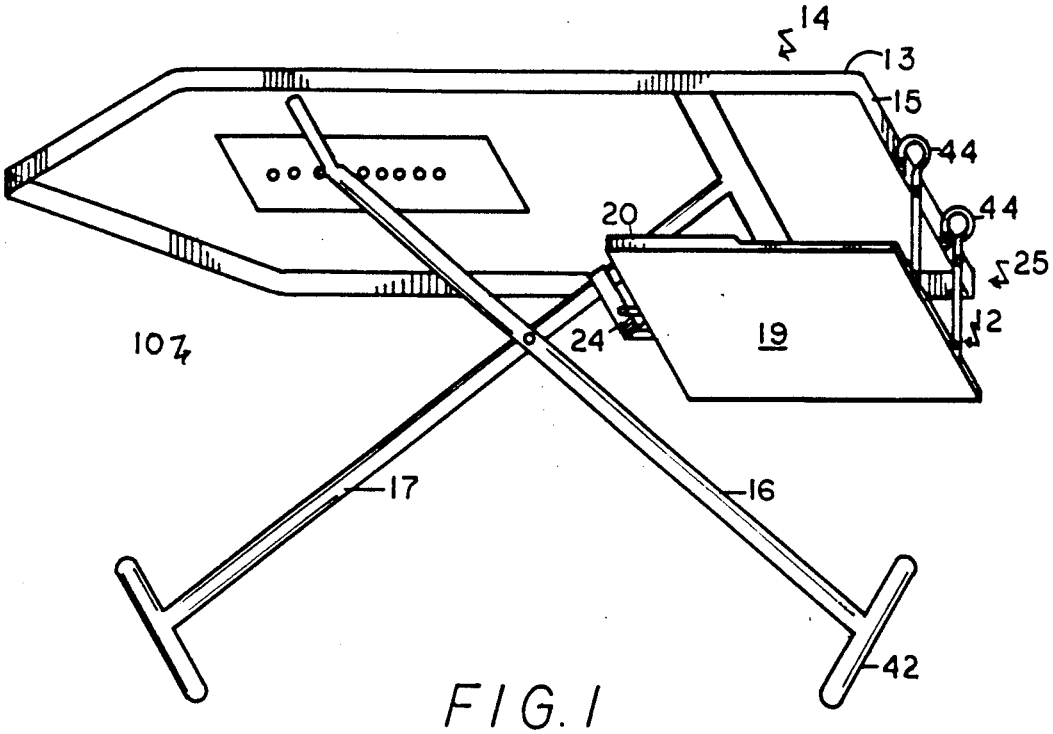
FIG. 1 is a isomeric perspective view of the ironing board system of the invention showing employment of the retractable work station attachment.

With reference to the drawings, FIG. 1 shows a retractable ironing board system 10, including a workstation attachment 12, an ironing board 14, comprising a board 13 having a flat end 15, a plurality of legs movably mounted on the board 13 with a rearwardly extending leg 16 joined by conventional joint means at mid section to a forwardly extending leg 17 in a "X" configuration with the upper distal ends of the legs 16 and 17 attached to the underside of the board 13 with each lower distal end having a conventional traverse base member 42 resting on the floor surface.

Figure 2:
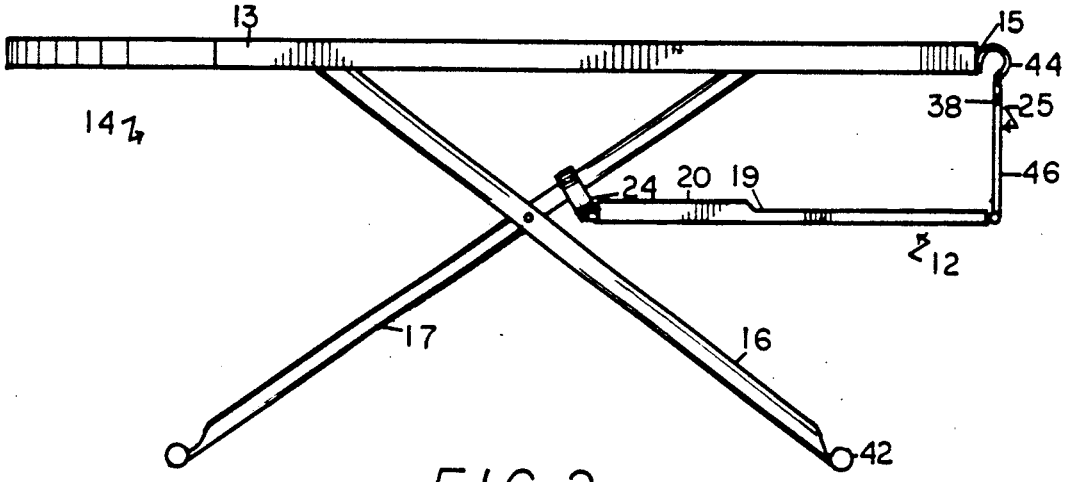
FIG. 2 is a side elevational view of an ironing board and the improved work attachment of the invention in the open position as employed in FIG. 1.
Figure 3:
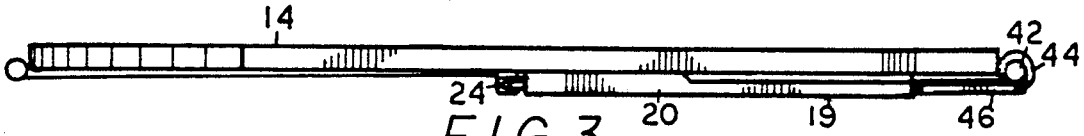
FIG. 3 is a side elevational view of the invention shown in the folded position, as employed in FIG. 1.
Figure 4:
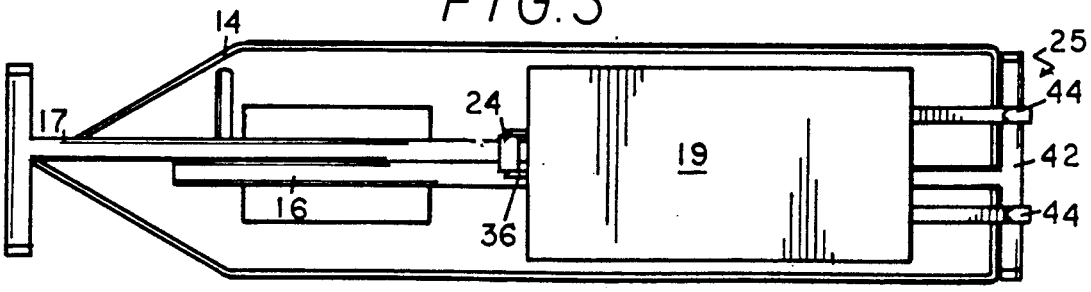
FIG. 4 is a bottom elevational view of the ironing board system of the invention in the folded position.
Figure 5:
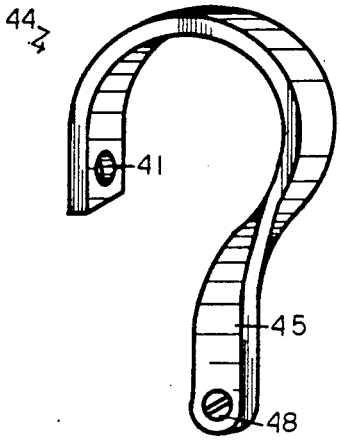
FIG. 5 is an enlarged view of the arch member of the improved retractable work station of the invention.

As illustrated in FIG. 2, the ironing board system of the invention has an open position, and as seen in FIGS. 3 and 4, a folded position for storage in a compact area.

Figure 6:
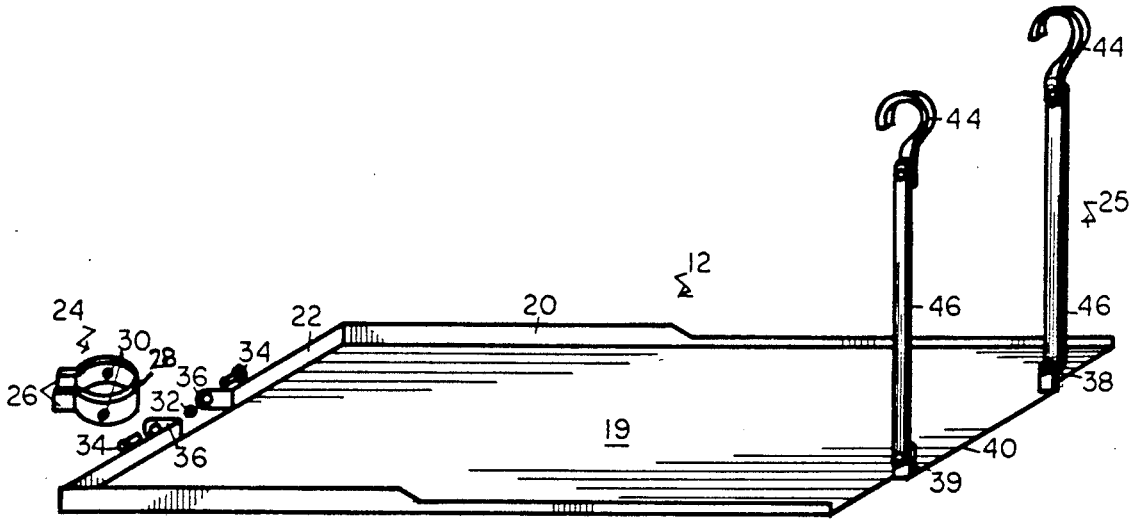
FIG. 6 is an perspective view of the improved retractable work station of the invention shown separately.

As illustrated in FIGS. 1, 2 and 6, the work station attachment 12 is comprised of a tray 19, a plurality of rib members 20 and a plurality of shoulders 22, and extends horizontally in parallel relationship with board 13, being attached by clamping at one end by an expandible coupling 24 to leg 17 and at the opposite generally open end by a plurality of support arms 25 secured to the flat end 15 of board 13 by bolt means. The coupling 24 includes a plurality of generally parallel tabs 26, and expandable collar 28 for clamping compressively on leg 17. The collar 28 also has a plurality of holes 30 positioned on opposite peripheral sides each for receiving a pivoting rivet 34 positioned in the distal ends of a pair of fingers 36 each mounted on the shoulder members 22 of tray 19. As illustrate din FIGS. 2 and 6, the support arms 25 extend upwardly in generally perpendicular relationship to tray 19 and comprises an arch 44 and strut 46 movably mounted in parallel relationship with bolt 38 mounted in holes 39 provided in a plurality of upwardly extending ends of "U" shaped hinge plate 40, secured to the open end of the tray 19. The upper arch 44 of each support arm 25 is constructed with an arcuate portion with an aperture 41 for bolting to one of a plurality of openings normally provided in ironing boards and includes a 90 degree twist in mid section to orient a base section 45 including a hinge pin bore 48 for attachment to and alignment with the joint end of a strut 46 by means of a hinge pin 47.

Also shown in FIG. 4 the traverse base 42 of leg 16 fits into arch members 44 such that the support arms 25 overlay the bottom of board 13, and support arms 25 do not interfere with legs 16 and 17.

The improved work station attachment 12 is adapted to be employed in a variety of ironing board system, wherein the legs, more particularly retractable legs 16 and 17 are constructed to be folded flat against the board 14 for ease of storage as shown in FIGS. 3 and 4. The ironing board system for retraction of conventional legs and workstation 12 attached thereto, would comprise an ironing board 14 having a plurality of legs in the present embodiment 16 and 17.

The legs being retractably mounted on the board 13 so as to have an open position and a retracted position on the underside of the board 13 with base sections 42 to provide secure support when the legs 16 and 17 are in the open position. The ironing board 13 is constructed with appointed end and a flat end 15, generally perpendicular to the ironing board sides and the workstation attachment 12 is affixed to the ironing board by a plurality of retractable support arms 25, each including an arch 44 and a strut 46, attached to the flat end 15 of the board 13 and expandable coupling means attached to one of the legs 17 hingably mounted at one end by a expandable coupling collar 24 on one of the leg 17 for retraction in a closed position adjacent the ironing board 14 when the legs 16 and 17 are folded against the board 14 for storage with coupling collar 24 disconnected from leg 17.

What is claimed is:

1. A work station attachment for an ironing board having a plurality of retractable legs comprising:

(a) a board member including a flat end, (b) a tray of generally rectangular shape having an open end and a coupling end comprising:

(i) a plurality of raised rib sections positioned adjacent the corners of the coupling end of the tray, (ii) a fixed hinge plate having an inverted "U" shape securely attached to the open end of the tray including a plurality of hinge means, (c) a plurality of support arms having a tray end and an ironing board end, each comprising:

(i) a plurality of hinge bolts for hingeably engaging the hinge plate, (ii) an arch member fastening means to engage the board member, and formed with a 90 degree bend at mid section, (iii) a strut hingeably connected to the arch member, (d) a plurality of fingers in parallel relationship each extending outwardly from the respective rib section of the tray, (e) an expandable coupling with a discontinuity and comprising:

(i) a plurality of outwardly extending tabs, (ii) a collar with aperatures on opposite sides of the collar for receiving pivot means.

2. A retractable board system comprising:

(A) an ironing board comprising (i) a board of conventional construction with a generally flat end, (ii) a plurality of retractable legs having an open position and a retracted position comprising:

(a) a rearwardly extending leg (b) a forwardly extending leg (c) transversal base member on each leg (B) a tray of generally rectangular shape having an open end and a coupling end comprising:

(i) a plurality of raised rib sections positioned adjacent corners of the coupling end of the tray, (ii) a fixed hinge plate having an inverted "U" shape securely positioned to the open end of the tray including hinge aperatures, (iii) a plurality of fingers in parallel relationship each extending outwardly from the tray, to hingeably cooperate with an expandable collar, (C) a plurality of support arms having a tray end and an ironing board end, each comprising:

(i) a hinge bolt for engaging the hinge plate, (ii) an arch member with a curved section having a distal end with fastening means adjacent the distal end, and formed with a 90 degree bend at mid section.

(iii) a strut hingeably connected to the arch by hinge pin rotatably received in hinge apertures provided in the arch and strut, (D) an expandable coupling with a discontinuity for compressively engaging on the rearwardly extending leg, providing a quick disconnect therefrom the retraction of the tray together with the board and retractable legs.

3. The retractable ironing board system of claim 2 wherein the support arms each have an upper section and a lower section and each is rotatably attached to the hinge plate by bolt means and the arch member includes a distal end with fastening means for attachment to the board adjacent the distal end, and formed with a 90 degree twist and being perpendicularly disposed to the arch section, the lower section being provided with hinge means for connecting the support arm with the tray, the arch end is securely fastened said flat end in apertures generally provided in the ironing board by bolt means.

4. The workstation attachment of claim 3 wherein the tray is provided with walls on three sides to contain articles placed on the tray.

5. The workstation attachment of claim 3, wherein the collar is rubber coated.

6. The workstation attachment of claim 3 wherein the legs and the tray lay flat against the board when in the retracted position.

* * * * *